US005635777A

United States Patent [19]

Telymonde et al.

[11] Patent Number: 5,635,777

[45] Date of Patent: Jun. 3, 1997

[54] FOOT OPERATED CONTROL APPARATUS

[75] Inventors: Timothy D. Telymonde, Keyport; Mark Iosim, Old Bridge, both of N.J.

[73] Assignee: Andrew Telymonde, Brick, N.J.

[21] Appl. No.: 579,234

[22] Filed: Dec. 28, 1995

[51] Int. Cl.[6] ..... H01H 21/26

[52] U.S. Cl. ..... 307/119; 73/146; 200/86.5

[58] Field of Search ..... 73/146; 74/512, 74/560; 307/119, 112, 115, 116; 340/665, 666; 200/86 R, 86.5, 61.89; 338/108, 32 H; 433/101; 345/157, 158

[56] References Cited

U.S. PATENT DOCUMENTS 4,965,417 10/1990 Massie ..... 200/86.5
4,970,486 11/1990 Gray ..... 338/2
5,091,656 2/1992 Gahn ..... 307/119
5,324,900 6/1994 Gonser ..... 200/86.5
5,422,521 6/1995 Neer ..... 307/119

*Primary Examiner*—Gerald P. Tolin
*Attorney, Agent, or Firm*—Patrick J. Pinto

[57] ABSTRACT

A foot operated control apparatus for randomly selecting any function and subsequently activating that function of a multi-function device that includes a base assembly and a foot operator assembly. The foot operator assembly is capable of being articulated in at least distinct three directions of travel with respect to the base assembly. The foot operator assembly may be selectively moved by the foot of the user in any of the directions, separately or in combination, to provide a floating-like movement. This apparatus includes indicating means for providing physical sensory indications to the user during the random selection and activation of a function.

14 Claims, 3 Drawing Sheets

FOOT OPERATED CONTROL APPARATUS

BACKGROUND OF THE INVENTION

1. Field of the Invention

This invention relates to foot operated switches for selecting and activation of particular functions of a multi-function apparatus.

2. Description of Related Art

Many of today's machines are multi-functional. These multi-functional machines usually require a control means for manually selecting one of the multi-functions. One example of a multi-function machine that requires manual selection of a function is a operating/imaging table. Usually the operating imaging table includes a patient bearing surface that is capable of being moved along one or more planes with respect to a physician or an imaging apparatus. This operating/imaging table usually is controlled by a hand held control. The hand held control has disadvantages due to the fact that the user hands may not available for grasping the control. One solution to this problem has been suggested in U.S. Pat. No. 5,422,521, that issued to Neer et al on Jun. 6, 1995. U.S. Pat. No. 5,422,521 discloses a foot operated control that sequentially indexes or scrolls through a menu of a multi-function machine. Then activation of the function requires the operator to move the control to a centered position for activation of a selected function.

It has been determined that there is a need for a foot operated control that allows easy selection or preparation of a particular function with subsequent activation of the function. This needed control may also provide a physical sensory indication to the user of a particular function to be selected. It has also been determined that there is a need for a the foot control that is adapted for cordless operation.

SUMMARY OF THE INVENTION

The present invention may be briefly summarized with respect to its objects. It is an object of this invention to provide and it does provide a foot operated control that allows movement of a foot operator assembly in at least two planes for random access to, and activation of functions of a multi-function device.

It is another object of this invention to provide and it does provide a foot operated control that is adapted for either corded operation or cordless operation.

It is still another object of this invention to provide and it does provide a foot operated control which provides a physical indication of its relative position to the foot of the user.

It is yet another object of this invention to provide and it does provide a foot operated control that includes a safety feature for minimizing the chance of accidental activation of a function or damage to the foot operated control.

One embodiment of the foot control of the present invention may be briefly summarized as: a foot operated control apparatus for randomly selecting a function and subsequently actuating that selected function of a multi-function device comprising: a) a base member and a foot operator assembly; b) the foot operator assembly including: an intermediate carriage that is reciprocally journalled on the base member for allowing selective movement along a first plane, the first plane being parallel to a major surface of the base member; a top plate that is reciprocally journalled to the intermediate carriage for allowing a second direction of movement of a sensing end of the top plate; the second direction of movement being along a path that is substantially transverse to the first direction; a foot plate that is pivotally attached to the top plate for allowing a selective rocker movement therebetween, the rocker movement being transverse to the second direction of movement; a biasing means for urging the foot plate towards a de-activated position, c) a plurality of position sensors for sensing the relative position of the sensing end of the top plate with respect to the base member, each of the position sensors being adapted for preparing a function of the multi-function device for selective activation; d) an activating means that senses the selective movement of the foot plate from the de-activated position to a first activated position, the first activated position providing a signal for activating the prepared function of the multi function device; and wherein the relative multi-directional movement of the foot operator assembly with respect to the base member prepares a function of the multi-function device for selective activation and the selective activation thereafter of the prepared function of the multi-function device being by only the rocker movement of the foot plate to the first activated position.

The first embodiment may include integral sensory indicators for providing a feedback to at least one of the physical senses of the user.

A second embodiment further includes an emitter circuit and a receiver circuit for providing a cordless remote operation.

This foot operated control simulates a floating-like action between the positions of the various function while providing the sensory indication to at least one of the physical senses of the user. The floating action provides random access to those functions absent scrolling. This means that the foot operated control may be moved in either a first direction, a second direction or diagonally. Immediate activation of a selected function may be made at each individual function position or site by the rocker-like movement of the foot plate.

In addition to the above summary, the following disclosure is intended to be detailed to insure adequacy and aid in the understanding of the invention, However, this disclosure, showing particular embodiments of the invention, is not intended to describe each new inventive concept that may arise. These specific embodiments have been chosen to show at least one preferred or best mode for a foot operated control of the present invention. These specific embodiments, as shown in the accompanying drawings, may also include diagrammatic symbols for the purpose of illustration and understanding.

Figure 3:
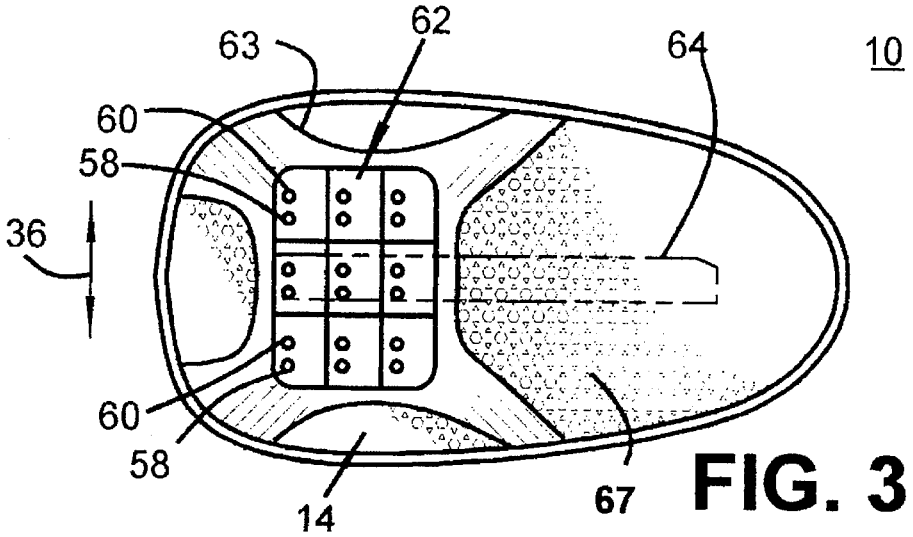
FIG. 3 represents a top elevation of the foot operated control apparatus.

In the following description and in the appended claims, various details are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention, as claimed. This invention may be incorporated into other structural forms than shown.

DETAILED DESCRIPTION OF THE INVENTION

Figure 1:
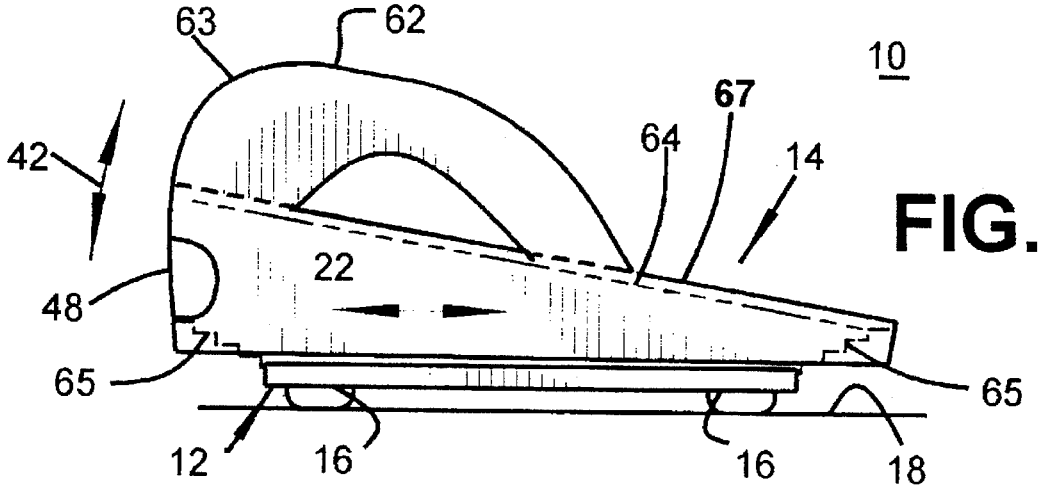
FIG. 1 represents a front elevation of a foot operated control apparatus of the present invention.
Figure 2:
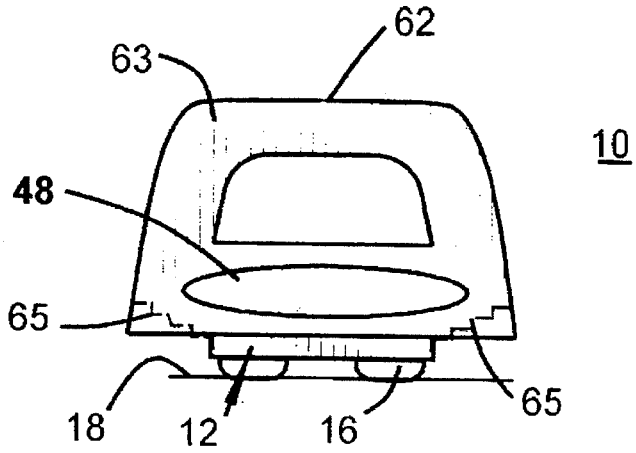
FIG. 2 represents a side elevation of the foot operated control apparatus.

Referring first to FIGS. 1, 2 and 3, a foot operated control apparatus of the present invention is generally identified as 10. This foot operated control apparatus 10 includes a base member assembly 12 and a foot operator assembly 14. The base member assembly 12 preferably includes a plurality of rubber feet 16 that are adapted to minimize any relative movement between the base member assembly 12 and its support structure 18, such as a floor.

Figure 5:
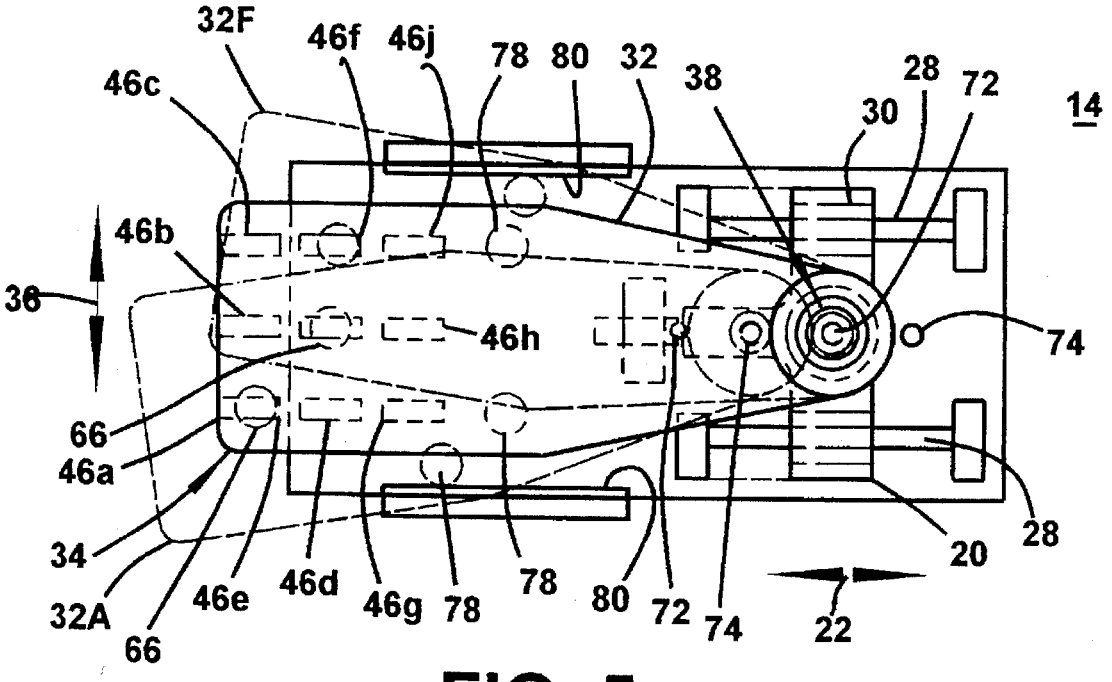
FIG. 5 represents a top view of the invention, this view being partly schematic of the present invention with the canopy removed.
Figure 4:
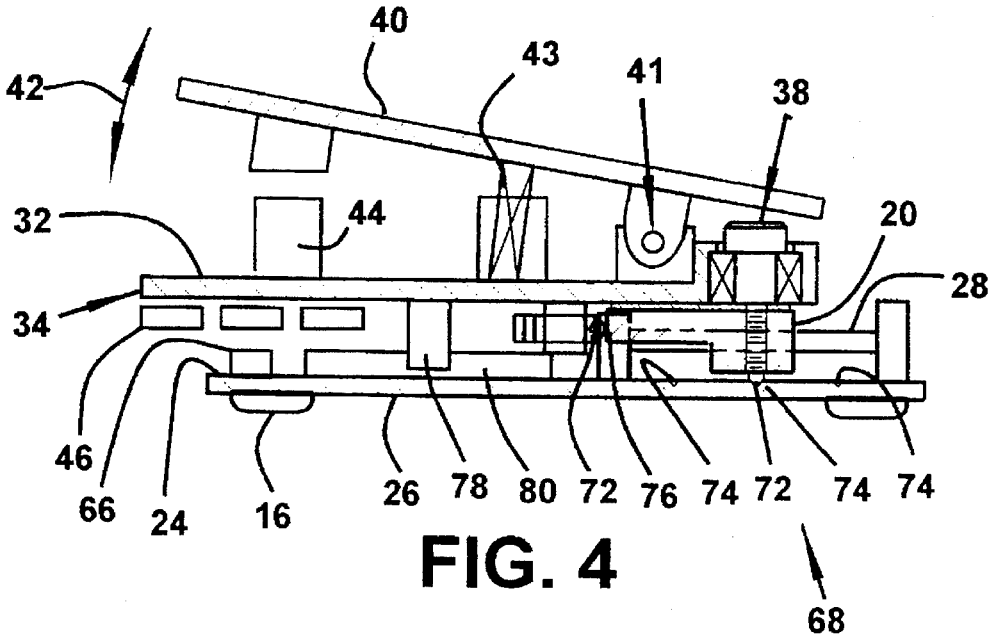
FIG. 4 represents a side elevation of the present invention, this view being in section and partly schematic, this view being shown with a canopy portion removed for ease of illustration.

Now referring to FIGS. 4 and 5, the foot operator assembly 14 includes an intermediate carriage 20 that is reciprocally mounted or journalled on the base member assembly 12. This reciprocal mounting allows the foot operator assembly to be selectively moved along a first path. The reciprocal direction of movement of the first path is depicted by arrow 22. The first path is along a plane that is substantially parallel to a major surface 24 of a base plate or member 26. One example of a reciprocal mounting is a pair of parallel precision shafts 28 that guide linear anti-friction bushings or bearings 30. Each of the anti-friction bushings or bearings 30 are retained in the intermediate carriage member 20. This reciprocal mounting arrangement may be reversed, if space allows. Alternative reciprocal mounting arrangements may be used such a single shaft with a cam follower in a track, a pair of anti-friction slide rails, or the like.

Referring in particular to FIG. 4, a top plate 32 is mounted or journalled to the intermediate carriage 20 to provide a reciprocal movement of a sensing end 34 of the top plate 32 along a second direction, that is depicted by the arrow 36. The second direction of movement is transverse to first path, depicted by the arrow 22 in FIG. 5. One example of a typical mounting of the top plate 32 to the intermediate carriage 20 includes a pivot connection 38. It is preferred that this pivot connection 38 include an anti-friction bearing capable of radial and thrust loading. It is also preferred that location of the pivot connection 38 be at an end of the top plate 32 that is distal to the sensing end 34. An alternative to pivot connection 38 would include a transverse linear slide arrangement that is similar to the connection between the base member 26 and the intermediate carriage 20. That linear slide arrangement has been discussed above.

Referring again to FIG. 4, a foot plate 40 is pivotally journalled to the top plate 32. This mounting arrangement, that is generally identified as 41, is adapted to provide a reciprocal rocker-like movement between the top plate 32 and the foot plate 40. The direction of rocker-like travel is in a third direction. This third direction is depicted by an arrow 42. It is preferred that a biasing means 43, such as a compression spring, an extension spring or the like, be used to keep one end of the foot plate 40 in a raised condition with respect to the top plate 32. This raised condition or deactivated position is depicted by the clockwise rotation of arrow 42. An activating means 44, such as limit switch, reed switch, proximity switch and the like, may be mounted to the foot plate 40 or the top plate 32 This activating means 44 should be arrayed for detecting the selective counter-clock wise rotation of the foot plate 40 with respect to the top plate 32.

Referring again to FIGS. 4 and 5, the sensing end of the top plate 32 includes a plurality of position sensors 46 mounted thereon. These position sensors are arrayed in a selected spaced relationship or pattern. The arrangement of these position sensors 46 will be discussed later, in connection with the use and operation of the present invention. These position sensors 46 may include limit switches, reed switches, proximity sensors fiber optics and the like.

Figure 6:
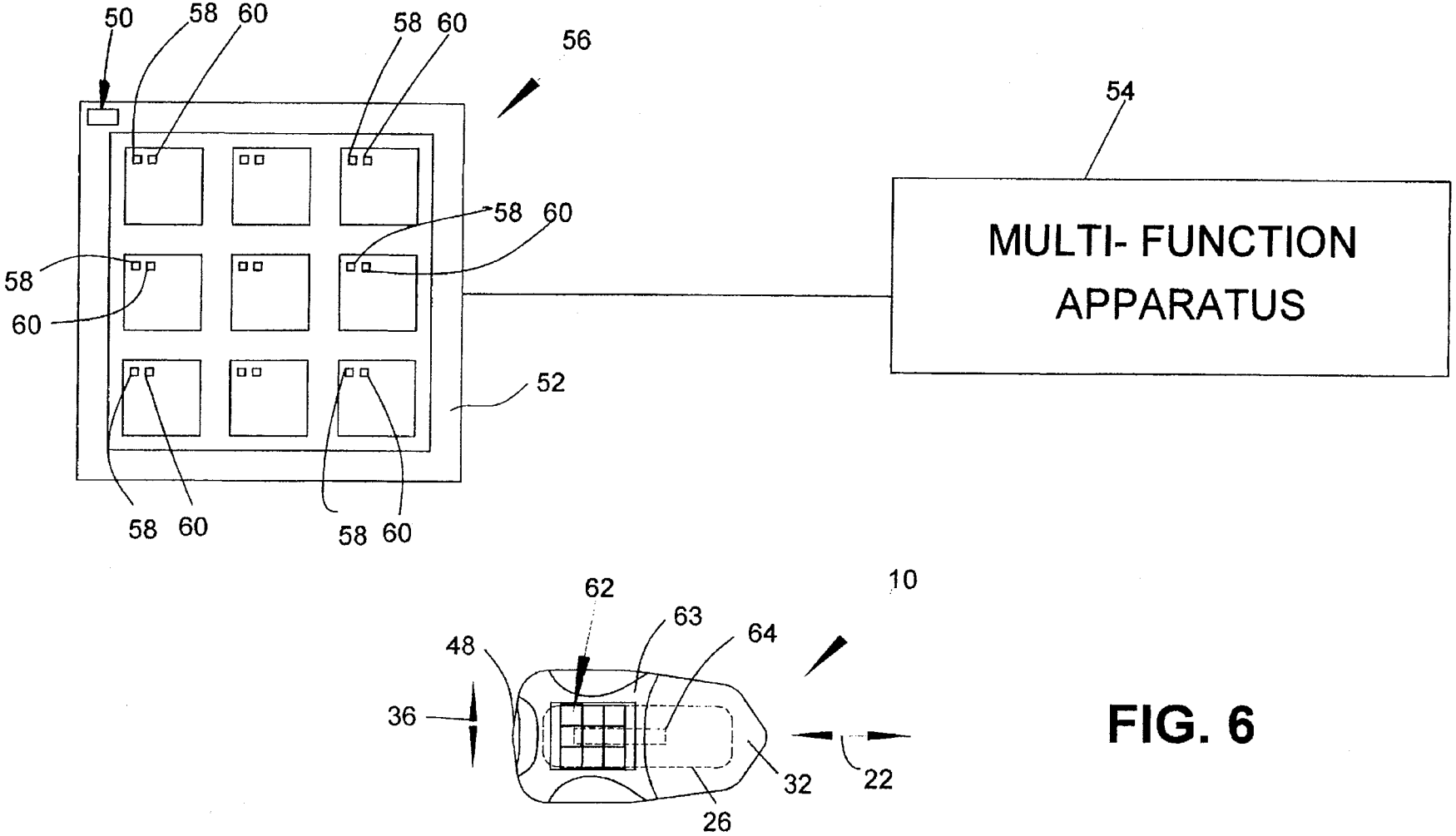
FIG. 6 represents the present invention and a remote display, this view being partly schematic.

The foot operated control assembly 10 may be hard wired to the multi function machine by an electrical cable assembly. However the present invention is also adapted to be used as a cordless remote, as depicted in FIG. 6. As a cordless remote, the selection and activation of the functions would be transmitted by infrared signals. An infrared emitter circuit 48 and window would be mounted on the foot operator assembly 14. A receiver circuit 50 would be housed in a console 52. The console 52 would be electrically connected to the function control circuit of the multi-function apparatus 54. The console 52 may include a remote visual display 56. The remote visual display 56 includes a plurality indicating lamps 58. Each function indicating lamp 58 is associated with a pictorial representation or text that describes the individual functions. The quantity of the function indicating lamps 58 is dependent on the number of functions. It is preferred that at least one activate indicating lamp 60 be provided on the display unit 56. It is also preferred that the function indicating lamps 58 and the activate indicating lamps be arrayed in pairs, at each function site, and in contrasting colors for easy visual differentiation thereof. Alternatively a plurality of function indicating lamps 58 in combination with a single activating lamp 60 may be used. As a second alternative the function display may include a means for back lighting a selected individual function of the display.

A visual display 62 may be provided on the foot operated control 10. This visual display 62 may be a miniature version of display 56. The visual display may be mounted on a canopy portion 63 of the foot control 10. Visual display 62 is preferred when the foot control 10 is hard wired directly to the multi-function machine 54, but not limited thereto. The visual display 62 may include indicating lamps, back lighting, LED's, and the like. The canopy portion 63 is depicted as having open sides. These open sides assist in carrying or moving the present invention from place to place.

It is anticipated that the foot operated control of the present invention may be used in wash down areas. A protective water-proof boot or bellows 65, as depicted in FIGS. 1 and 2. The boot or bellows 65 would be capable of enclosing the operating mechanism and circuitry of the foot operated control assembly 10.

Referring again to FIGS. 1 and 3, it is preferred that at least one sensing pad 64 be installed integrally with or under a non-skid mat 67 on the foot plate 40. This sensing pad 64 is connected in series with the function select circuitry and activate circuitry. This sensing pad 64 is used to detect the presence of the users foot on the foot plate 40. In this preferred arrangement and safety feature, the function select and subsequent activate signals could not be accidentally energized without a foot depressing the sensing pad 64. This feature is also important with a foot control assembly 10, that is cordless and battery operated. In the cordless operation the sensing pad or switch 64 would also act as an On-Off switch for providing power to the circuitry. This arrangement would maximize battery life. It is anticipated that the cordless foot switch control of the present invention may be powered by solar cells with a battery back-up.

USE AND OPERATION

The use and operation of the foot control assembly 10 is best described by way of an example. This example, that is described below, is a foot control assembly 10 that is adapted for selecting and activating one of nine total functions. Referring again to FIGS. 4 and 5, a plurality of position sensors 46 are identified as 46*a*; 46*b*; 46*c*; 46*d*; 46*e*; 46*f*; 46*g*; 46*h*, 46*j*. The user selects a desired function by moving the foot plate 40. The foot plate 40 in turn moves the top plate 32 relative to the base member assembly 12. The top plate 32 depicted as a solid line is in position for energizing function switch 46*e*. The top plate depicted in dashed outline and identified as 32A is in position for energizing function switch 46*a*. The top plate depicted in dashed outline and identified as 32F is in position for energizing function switch 46*f*. The base member 26 would have a first exciter 66 for the plurality of position sensors 46. The movement of the foot plate 40 by the users foot in the direction of arrow 22 or arrow 36 or diagonally. The placement of the first exciter 66 under one of the function sensors 46 will provide a selection of a particular function. The selected function will be indicated on either the remote visual display 56 and/or the integral visual display 62. It can easily be seen that the user may select any function by merely moving the foot plate 40 in any desired direction. Placement of ones foot on the sensing pad 64 will provide immediate indication of the current position. The foot control assembly 10 may alternatively be provided with a biasing means for returning the top plate to a home position. The particular function that has been selected and indicated on one or both of the displays may then be immediately activated by moving the foot plate 40 in the third direction, shown as arrow 42. This movement closes the activate circuit through the activate means 44.

It is preferred that the foot control assembly 10 include locating means 68. The locating means may include a pattern of a plurality of depressions in the base member 26, raised guides, and the like. It has been found that a locating means 68 that is a combination of a mechanical ball detent 72 and depressions 74, corresponding to the number of rows of the functions provides sensory feed back to the foot of the row selected. Sufficient column selection feed back has been found by using; a mechanical ball detent 72 cooperating with at least one column depression 76; and end stops 78. The end stops 78 are adapted to contact and ride along a pair of side guides 80. This arrangement provides the touch indication for up to nine separate functions. An increase in number of row depressions 74 and/or column depressions 76 will increase the number of functions that can be controlled and activated by a single foot control. The floating-like action of the foot plate 40 with respect to the base member assembly 12 will allow random selection and activation of any function that is controlled by the foot control assembly 10. It is expected that the locating means 68 allows the experienced user to identify the column and row of the function without needing to look at a visual display. It has been found that this locating means 68 will shorten the period for selecting and activating the functions or movements of a multi-function apparatus.

The pivot connection 38 has been selected for allowing the user to move the foot plate 40 in a natural manner, by having the pivot connection 38 near the heel portion of the users foot.

It is to be noted that the sensing pad 64 and the activating means 44 may be interlocked electrically. This interlocking arrangement provides an audible signal that indicates that the foot operator assembly 14 is being tilted when a foot is not in the correct position for energizing the sensing pad 64. This interlock may also act as an anti-crash feature. This feature would provide an audible signal and a control signal for stopping any movement of a multi-function apparatus when the foot operated control apparatus 10 is in harms way. This anti-crash feature would be of value in the event that the apparatus 10 was accidentally placed under a table of a multi-function device and in danger of being crushed. This situation would probably only occur in the event that operation and control of that multi-function apparatus was by means other that the foot operated control 10, such as its on-board control panel.

Directional terms such as "clockwise", "counter-clockwise", "front", "back", "in", "out", downward, upper, lower and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A foot operated control apparatus for randomly selecting a function and subsequently actuating that selected function of a multi-function device comprising:

a) a base member and a foot operator assembly;

b) the foot operator assembly including b1) an intermediate carriage that is reciprocally journalled on the base member for allowing selective movement along a first direction of movement, the first direction of movement being along a plane that is parallel to a major surface of the base member;

b2) a top plate that is reciprocally journalled to the intermediate carriage for allowing a second direction of movement of a sensing end of the top plate; the second direction of movement being along a path that is transverse to the first direction of movement;

b3) a foot plate that is pivotally attached to the top plate for allowing a selective rocker movement therebetween, the rocker movement being transverse to the second direction of movement;

b4) a biasing means for urging the foot plate towards a de-activated position, c) a plurality of position sensors for sensing the relative position of the sensing end of the top plate with respect to the base member, each of the position sensors being adapted for preparing a function of the multi-function device for selective activation;

d) an activating means that senses the selective movement of the foot plate from the de-activated position to a first activated position, the first activated position providing a signal for activating the prepared function of the multi function device; and wherein the relative multi-directional movement of the foot operator assembly with respect to the base member prepares a function of the multi-function device for selective activation and the selective activation thereafter of the prepared function of the multi-function device being by only the rocker movement of the foot plate to the first activated position.

2. A foot operated control apparatus as recited in claim 1 which further includes a display means for providing a visual indication of the function prepared for selective activation.

3. A foot operated control apparatus as recited in claim 2 wherein the display means further includes a visual indication of activation of the function.

4. A foot operated control apparatus as recited in claim 1 which further includes at least one sensing pad mounted on the foot plate for providing a determination that a foot of the user is positioned on the foot plate.

5. A foot operated control apparatus as recited in claim 4 wherein the activating means further includes:

an emitter circuit that is mounted thereon;

a receiving circuit that is connected to the multi function device; and wherein the emitter circuit and the receiving circuit cooperate for providing a cordless preparation and activation of the functions of the multi-function device.

6. A foot operated control apparatus as recited in claim 5 wherein the foot sensing pad further provides an on-off control for the display means and the activating means.

7. A foot operated control apparatus as recited in claim 6 wherein a removable battery provides the power for the emitter circuit and the activating means.

8. A foot operated control apparatus as recited in claim 1 which further includes a plurality of locating means, each locating means providing a sensory indication of a position of each function, the sensory indication also providing physical indication to a foot placed on the foot plate.

9. A foot operated control apparatus as recited in claim 2 wherein the visual display is attached to the foot operator assembly.

10. A foot operated apparatus as recited in claim 2 which further includes a remote console, the remote console having the visual display mounted thereon.

11. A foot operated apparatus as recited in claim 1 wherein the second direction of movement of the sensing end of the top plate is along a radial path, a center of the radial path being near an second end of the top plate that second end being distal to the sensing end.

12. A foot operated apparatus as recited in claim 11 wherein the second end is adapted for placement of a heel portion of a foot of the user.

13. A foot operated apparatus as recited in claim 1 wherein the activating means further includes at least one additional activated position, each additional activated position providing activation of a mode of the prepared function.

14. A foot operated apparatus as recited in claim 4 wherein the activating means also provides a signal for indicating the accidental activation thereof by rocker movement while simulataneously sensing the absence of a foot on the sensing pad.

* * * * *